US006798430B2

(12) United States Patent
Sato

(10) Patent No.: US 6,798,430 B2
(45) Date of Patent: Sep. 28, 2004

(54) TANDEM TYPE COLOR IMAGE FORMING DEVICE HAVING A PLURALITY OF PROCESS CARTRIDGES ARRAYED IN RUNNING DIRECTION OF INTERMEDIATE IMAGE TRANSFER MEMBER

(75) Inventor: Shougo Sato, Seto (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 354 days.

(21) Appl. No.: 09/879,000

(22) Filed: Jun. 13, 2001

(65) Prior Publication Data

US 2001/0055499 A1 Dec. 27, 2001

(30) Foreign Application Priority Data

Jun. 14, 2000 (JP) ..... 2000-178513
Jun. 16, 2000 (JP) ..... 2000-181350

(51) Int. Cl.[7] ..... B41J 2/385; B41J 2/41; G03G 15/00; G03G 15/01

(52) U.S. Cl. ..... 347/115; 347/138; 347/140; 347/152; 347/154; 347/116; 399/401; 399/299

(58) Field of Search ..... 347/138, 140, 347/152, 154, 115, 116, 235, 129, 131, 132; 399/401, 299, 111, 112, 116, 110

(56) References Cited

U.S. PATENT DOCUMENTS 4,030,445 A * 6/1977 Takenaga et al. ..... 399/227
4,763,241 A * 8/1988 Egawa et al. ..... 347/132
4,847,644 A * 7/1989 Oda et al. ..... 347/258
5,444,515 A * 8/1995 Haneda et al. ..... 399/112
5,946,523 A * 8/1999 Fujioka et al. ..... 399/49
6,188,419 B1 * 2/2001 Katamoto et al. ..... 347/129
6,236,820 B1 * 5/2001 Nakazato et al. ..... 399/111

FOREIGN PATENT DOCUMENTS

JP 8-190245 A 7/1996
JP 09-006083 * 1/1997 ..... G03G/15/01

* cited by examiner

*Primary Examiner*—Andrew H. Hirshfeld
*Assistant Examiner*—Wasseem H. Hamdan
(74) *Attorney, Agent, or Firm*—Oliff & Berridge, PLC

(57) ABSTRACT

A tandem type color image forming device having a plurality of process cartridges each being detachable from a frame. An intermediate image transfer belt extends vertically, and the process cartridges are arrayed in the vertical direction and supported by the frame. Each process cartridge installs therein a developing unit and a photosensitive drum, and each photosensitive drum is in confrontation with the belt. A front cover is provided in front of the process cartridges. If viewing from the front, when the front cover is opened, the process cartridges are accessible without any interference with ambient components, and the belt is positioned behind the process cartridges.

21 Claims, 9 Drawing Sheets

TANDEM TYPE COLOR IMAGE FORMING DEVICE HAVING A PLURALITY OF PROCESS CARTRIDGES ARRAYED IN RUNNING DIRECTION OF INTERMEDIATE IMAGE TRANSFER MEMBER

BACKGROUND OF THE INVENTION

The present invention relates to a color image forming device having an intermediate image transfer member and a plurality of electrostatic latent image bearing bodies disposed following the movement direction of the intermediate image transfer member. Each of the electrostatic latent image bearing bodies is for developing a different color of an image, A tandem type color image forming device has been known in which toners of cyan, magenta, yellow and black are contained in respective developing units, and electrostatic latent image bearing bodies each disposed beside each developing unit are aligned in a direction. According to the tandem type device, developing operations in the respective developing units are performed almost concurrently. Therefore, color image can be formed at high speed.

However, in the conventional tandem type color image forming device, a plurality of process units each including a photosensitive drum and a developing device are arrayed linearly in a direction parallel with an installing floor for the image forming device. Consequently, large installation area is required.

To avoid this problem, Japanese Patent Application publication No. Hei-8-190245 discloses a color image forming device in which the plurality of the process units are arrayed in a vertical direction to reduce the installation area of the entire device. However, in the disclosed color image forming device, a sheet discharge tray projects from a side wall of the image forming device, and each developing device is bulky and has a complicated construction. Consequently, resultant image forming device becomes bulky.

Further, in the conventional device, a vertical side wall plate is pivotably supported to a main frame, so that the side wall plate can be opened and closed for exchanging the process unit with a new unit. The vertical side wall plate extends in a direction perpendicular to each rotation axis of each photosensitive drum. That is, the side wall plate is positioned in confrontation with each end of each photosensitive drum. At this place, there is provided a mechanism for positioning the rotation shaft of the photosensitive drum, or a mechanism for positioning a rotation shaft of a drive roller for driving the intermediate image transfer belt. These mechanisms will become obstacles against the exchanging work, and will degrade the accurate positioning of the exchanged process unit. As a result, color image displacement may occur in the resultant color image in which one color image is slightly displaced from the other color images.

SUMMARY OF THE INVENTION

It is an object of the present invention to provide a compact color image forming device capable of being installed in a limited installation area.

Another object of the present invention is to provide such device eliminating displacement of one color image from other color images in a image recoding sheet.

These and other objects of the present invention will be attained by an improved color image forming device including a frame, an elongated intermediate image transfer member, a plurality of electrostatic latent image bearing bodies, a plurality of chargers, a plurality of exposure units, a plurality of developing units. The frame includes a pair of side frames. The elongated intermediate image transfer member runs substantially in a vertical direction and is positioned between the pair of side frames. The intermediate image transfer member has a first side. The plurality of electrostatic latent image bearing bodies are aligned substantially in the vertical direction and are positioned in confrontation with the first side of the intermediate image transfer member. Each electrostatic latent image bearing body has a latent image bearing surface. The plurality of chargers charge the latent image bearing surface of corresponding ones of the electrostatic latent image bearing bodies The plurality of exposure units expose charged surfaces of corresponding ones of the electrostatic latent image bearing bodies. The plurality of developing units each includes a developing agent bearing body disposed in confrontation with a corresponding one of the plurality of electrostatic latent image bearing bodies and houses therein developing agents of different colors. At least each developing unit is assembled in each process cartridge, and each process cartridge is detachably positioned at a side facing the first side and is moved in an attachment/detachment direction toward and away from the first side for attachment and detachment of the process cartridge with respect to the pair of side frames.

In another aspect of the invention, there is provided a color image forming device including the frame, the plurality of electrostatic latent image bearing bodies, an elongated intermediate image transfer member, a plurality of developing units, a plurality of chargers, and the plurality of exposure units. The elongated intermediate image transfer member runs substantially in a vertical direction and has a first side running downwardly. The plurality of developing units each includes the developing agent bearing body and a layer thickness regulation member in contact with the developing agent bearing body and positioned below the developing agent bearing body for regulating a thickness or a layer of the developing agent formed thereon. The developing agent comprises a non-magnetic single component type developing agent. The plurality of chargers is each positioned in confrontation with the latent image bearing surface of corresponding ones of the electrostatic latent image bearing bodies for charging the latent image bearing surface.

In still another aspect of the invention, there is provided a color image forming device including a frame, an elongated intermediate image transfer member, a plurality of electrostatic latent image bearing bodies, a plurality of developing units, a supply tray and a discharge tray. The elongated intermediate image transfer member runs substantially in a vertical direction, and has a first side running downwardly. The plurality of electrostatic latent image bearing bodies are aligned substantially in the vertical direction and are positioned in confrontation with the first side of the intermediate image transfer member. Each electrostatic latent image bearing body has a latent image bearing surface. The plurality of developing units each includes the developing agent bearing body. The supply tray is adapted for supplying an image recording medium to the intermediate image transfer member. The discharge tray is adapted for receiving an image recording medium formed with a color image. The intermediate image transfer member, the plurality of the electrostatic latent image bearing bodies, and the plurality of the developing units are positioned below the discharge tray but are positioned above the supply tray.

In still another aspect of the invention, there is provided a color image forming device including the frame, the elongated intermediate image transfer member, the plurality of electrostatic latent image bearing bodies, the plurality of developing units each includes the developing agent bearing body, a secondary image transfer device, a fixing device, and a reverse mechanism. The secondary image transfer device is positioned immediately below the intermediate image transfer member for transferring an image from the intermediate image transfer member onto an image recording medium. The fixing device is adapted for fixing the image onto the image recording medium after the image has been transferred from the intermediate image transfer member onto the image recording medium. The reverse mechanism is adapted for reversing a surface of the image recording medium to provide another image onto a reverse surface of the identical image recording medium. The reverse mechanism is connected to a downstream of the fixing device and to an upstream of the secondary image transfer device by way of a reverse print pathway extending below the intermediate image transfer member.

BRIEF DESCRIPTION OF THE DRAWINGS

In the drawings:

FIG. 7(*b*) is a schematic view showing a waste toner path of a cleaning arrangement including a waste toner transfer units and waste toner container in the laser printer according to the second embodiment;

DETAILED DESCRIPTION OF THE PREFERRED EMBODIMENTS

A color laser printer as a color image forming device according to a first embodiment of the present invention will be described with reference to FIGS. 1 through 4.

Figure 1:
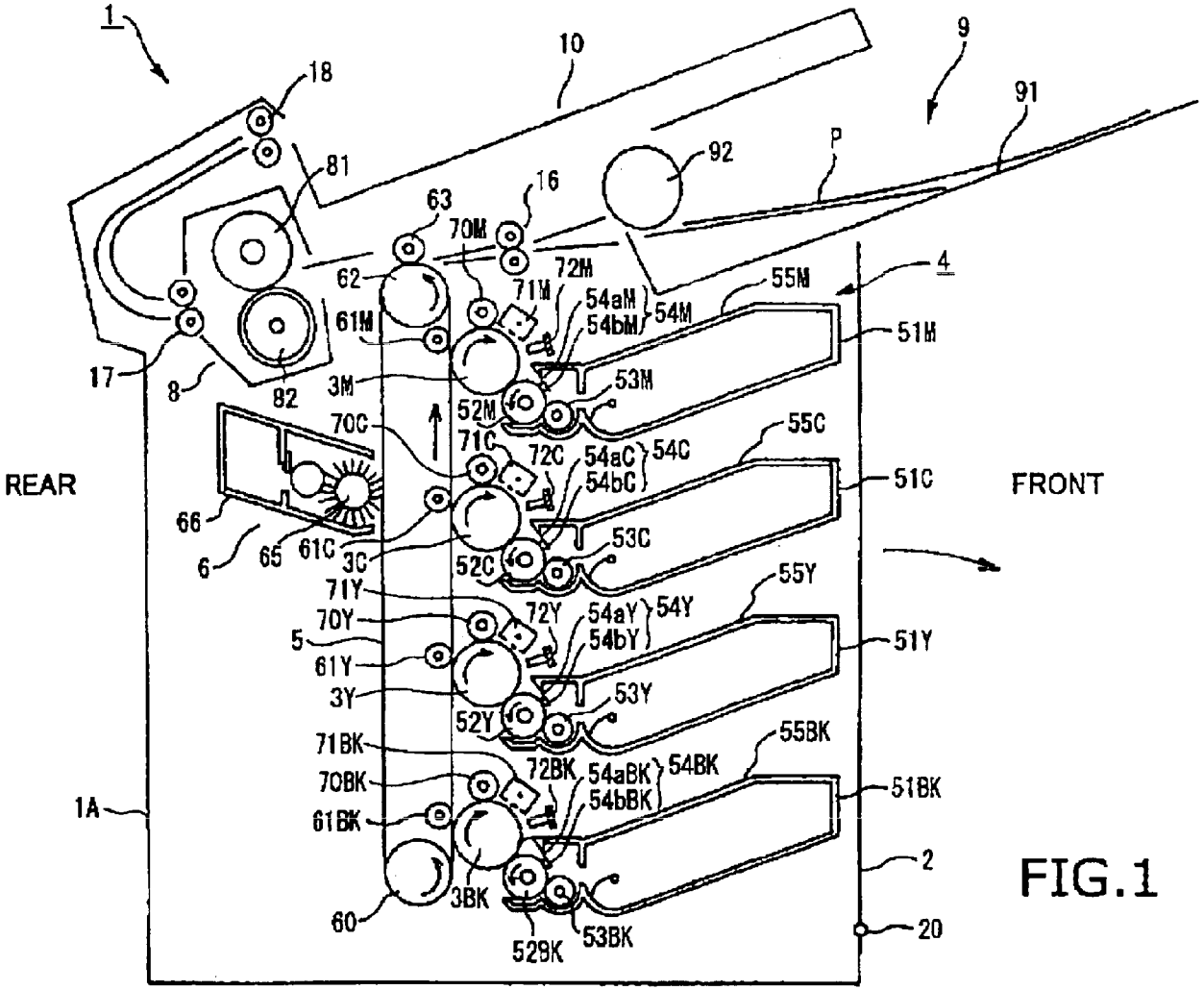
FIG. 1 is a schematic cross-sectional side view showing a color laser printer as applied with a color image forming device according to a first embodiment of the present invention.

The color image forming device 1 shown in FIG. 1 generally includes a main frame 1A, a front cover 2, a visible image forming portion 4, a belt-shaped intermediate image transfer member 5, a fixing unit 8, a sheet supply unit or tray 9, and a sheet-discharge tray 10.

The visible image forming portion 4 includes various components for producing a visible image for each one of magenta (M), cyan (C), yellow (Y), and black (Bk) colored toner. That is, the visible image forming portion 4 includes developing units 51M, 51C, 51Y, and 51Bk, photosensitive drums 3M, 3C, 3Y, 3Bk, cleaning rollers 70M, 70C, 70Y, 70Bk, charge units 71M, 71C, 71Y, 71Bk, and LED arrays 72M, 72C, 72Y, 72Bk. These components will be described in further detail below.

The developing units 51M, 51C, 51Y, 51Bk include developing rollers 52M, 52C, 52Y, 52Bk as a developing agent carrying members. The developing rollers 52M, 52C, 52Y, 52Bk each has a cylindrical shaped base member made from electrically conductive silicone rubber and a coating layer coated over the base member and made from rubber or resin containing fluorine. As a material of the base member, electrically conductive urethane rubber can be used instead of the electrically conductive silicone rubber. The developing rollers 52M, 52C, 52Y, 52Bk have a surface roughness Rz (ten points average surface roughness) of 3 to 5 microns, which is smaller than the average particle size of toner, which is 9 microns. Each of the developing rollers 52M, 52C, 52Y, 52Bk is applied with a predetermined voltage to create a predetermined potential difference relative to the corresponding photosensitive drums 3M, 3C, 3Y, 3Bk.

The developing units 51M, 51C, 51Y, 51Bk also include toner supply rollers 53M, 53C, 53Y, 53Bk, which are electrically conductive sponge rollers positioned in pressure contact with the developing rollers 52M, 52C, 52Y, 52Bk because of elasticity of the sponge. It should be noted other materials such as electrically conductive silicone rubber or urethane rubber could be used for the toner supply rollers 53M, 53C, 53Y, 53Bk instead of the electrically conductive sponge. The developing units 51M, 51C, 51Y, 51Bk also include layer thickness regulating blades 54M, 54C, 54Y, 54Bk made from stainless steel. The layer thickness regulating blades 54M, 54C, 54Y, 54Bk include support portions 54*a*M, 54*a*C, 54*a*Y, 54*a*Bk and contact portions 54*b*M, 54*b*C, 54*b*Y, 54*b*Bk. The support portions 54*a*M, 54*a*C, 54*a*Y, 54*a*Bk are fixed at their bases to developing cases 55M, 55C, 55Y, 55Bk. The contact portions 54*b*M, 54*b*C, 54*b*Y, and 54*b*Bk are connected to the free end of the support portions 54*a*M, 54*a*C, 54*a*Y, 54*a*Bk and are made from an electrically conductive silicone rubber or an electrically conductive fluorine containing rubber or resin. The contact portions 54*b*M, 54*b*C, 54*b*Y, 54*b*Bk are in pressure contact with the developing rollers 52M, 52C, 52Y, 52Bk by resilient force of the support portions 54*a*M, 54*a*C, 54*a*Y, 54*a*Bk. As shown in FIG. 1, the contact portions 54*b*M, 54*b*C, 54*b*Y, 54*b*Bk have an outward-protruding and substantially semi-circular shape. According to the present embodiment, the layer thickness regulating blades 54M, 54C, 54Y, 54Bk are applied with a predetermined voltage in association with the developing rollers 52M, 52C, 52Y, 52Bk.

The toner housed in the developing cases 55M, 55C, 55Y, 55Bk is a non-magnetic single-component developing agent that has a positively charging nature. Each toner is composed of a toner base particles and an external additive. The toner base particle has an average particle diameter of about 9 microns. The toner base particles are formed by adding a well-known coloring agent, such as carbon black, and a charge control resin or agent, such as nigrosine, triphenylmethane, and quaternary ammonium salt, to styrene acryl resin that has been formed into a spherical shape by suspension polymerization. The toner is configured by adding silica as the external additive to the surface of the toner base particles. The silica is subjected to well-known hydrophobic enhancing processes with using silane coupling agent, silicone oil, and the like. The silica has an average particle size of 10 nm and is added in amounts equaling 0.6% by weight of the toner base particles. The developing cases 55M, 55C, 55Y, 55Bk house therein such magenta, cyan, yellow, and black toner, respectively.

The toner has excellent fluidity because it is suspension polymerization toner having nearly perfect spherical shapes and because the hydrophobic-enhanced silica with average particle size of 10 nm is added as the additive in an amount of 0.6% by weight. For this reason, a sufficient charge amount can be obtained by friction charging. Further, the toner does not easily receive mechanical force because it has no angled portions in the manner of pulverized toner. Therefore, the toner provides sufficient followablity to electric fields and so has very high image transfer efficiency. The non-magnetic single-component developing agent can reduce size of the developing unit 51M, 51C, 51Y, 51Bk, thereby reducing entire size of the printer 1.

The photosensitive drums 3M, 3C, 3Y, 3Bk serving as electrostatic latent image bearing bodies each includes an aluminum base member functioning as a grounded layer and a photosensitive layer formed thereon. The photosensitive layer has a positively charging nature and has a thickness not less than 18 microns. The photosensitive drums 3M, 3C, 3Y, 3Bk are driven to rotate in a direction shown in FIG. 1.

The cleaning rollers 70M, 70C, 70Y, 70Bk serving as cleaning units are rollers formed from an electrically conductive resilient body, such as a sponge material, and are disposed in sliding abrasive contact with the photosensitive drums 3M, 3C, 3Y, 3Bk, respectively. A power source (not shown) is provided for applying a negative-polarity voltage, which is the opposite polarity of the toner, to the cleaning rollers 70M, 70C, 70Y, 70Bk. The cleaning rollers 70M, 70C, 70Y, 70Bk are adapted for removing residual toner from the photosensitive drums 3M, 3C, 3Y, 3Bk by abrasion with the photosensitive drums 3M, 3C, 3Y, 3Bk and by the electric field generated by the applied voltage. It should be noted that because a cleaner-less developing method is used according to the present embodiment, the residual toner removed by the cleaning rollers 70M, 70C, 70Y, 70Bk can be returned back to the photosensitive drums 3M, 3C, 3Y, 3Bk during a predetermined cycle after developing processes are completed.

Scorotron chargers are used as the charge units 71M, 71C, 71Y, and 71Bk. These chargers are disposed in confrontation with the surface of the photosensitive drums 3M, 3C, 3Y, 3Bk and at a position downstream of the cleaning rollers 70M, 70C, 70Y, 70Bk with respect to the rotational direction of the photosensitive drums 3M, 3C, 3Y, 3Bk. Roller type charge units in contact with the photosensitive drums 3M, 3C, 3Y, 3Bk are available as the charge units 71M, 71C, 71Y, 71Bk instead of the scorotron chargers.

The LED arrays 72M, 72C, 72Y, 72Bk serving as exposing units are disposed in confrontation with the surface of the photosensitive drums 3M, 3C, 3Y, 3Bk at a position downstream of the charge units 71M, 71C, 71Y, and 71Bk with respect to the rotational direction of the photosensitive drums 3M, 3C, 3Y, 3Bk. The LED arrays 72M, 72C, 72Y, 72Bk are adapted for irradiating light based on image data onto the surface of the photosensitive drums 3m, 3C, 3Y, 3Bk, thereby forming electrostatic latent images for different colors on the surfaces of the photosensitive drums 3M, 3C, 3Y, 3Bk.

Positively charged toner is transferred from the developing rollers 52M, 52C, 52Y, 52Bk to the positively charged electrostatic latent image formed on the photosensitive drums 3M, 3C, 3Y, 3Bk at a position in contact with the developing rollers 52M, 52C, 52Y, 52Bk. This is referred to as an inversion developing method and is capable of forming images with extremely high quality.

Figure 2:
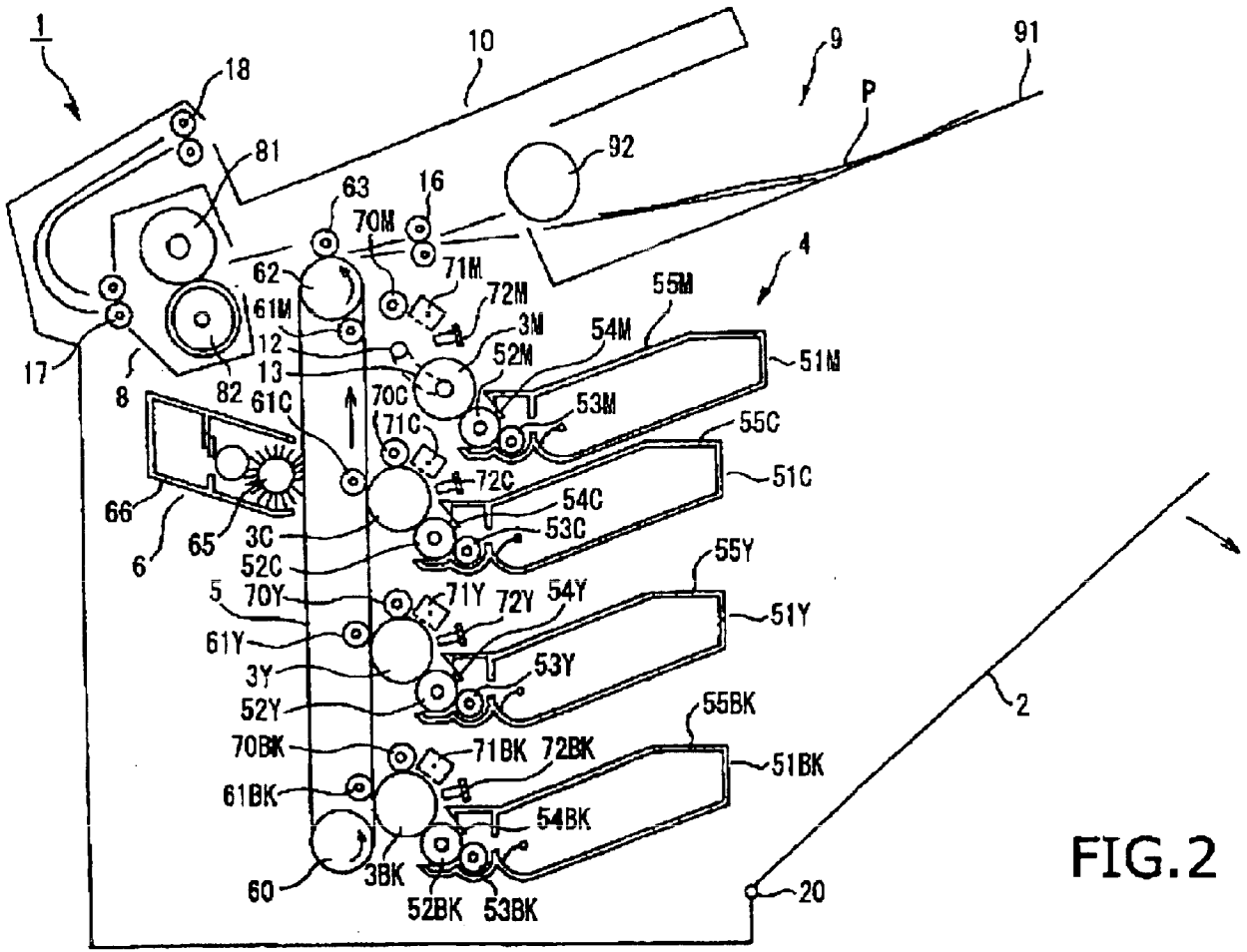
FIG. 2 is a schematic cross-sectional side view showing the state where a front cover is opened for exchanging a top process cartridge according to the first embodiment.

In the first embodiment, the photosensitive drums 3M, 3C, 3Y, 3Bk and the developing units 51M, 51C, 51Y, 5Bk are assembled in process cartridges, so that each combination of the photosensitive drum and the developing unit is integrally detachable from the main frame 1A of the printer 1 as shown in FIG. 2. On the other hand, the cleaning rollers 70M, 70C, 70Y, 70Bk, the chargers 71M, 71C, 71Y, 71Bk, and the LED arrays 72M, 72C, 72Y, 72Bk are fixed to the main frame 1A of the printer 1.

The intermediate image transfer member 5 is formed in a belt shape from an electrically conductive sheet made from polycarbonate or polyimide for example. As shown in FIG. 1, the intermediate image transfer belt 5 is wrapped around two drive rollers 60, 62. Intermediate image transfer rollers 61M, 61C, 61Y, 61Bk are provided in confrontation with the intermediate image transfer belt 5 at the side nearer the photosensitive drums 3M, 3C, 3Y, 3Bk. The intermediate image transfer belt 5 moves upward as indicated by an arrow in FIG. 1 at the side facing the photosensitive drums 3M, 3C, 3Y, 3Bk.

The intermediate image transfer rollers 61M, 61C, 61Y, 61Bk are applied with a predetermined voltage so that the toner images on each of the photosensitive drums 3M, 3C, 3Y, 3Bk can be transferred onto the intermediate image transfer belt 5 made from electrically conductive sheet. Also, a roller 63 is provided in confrontation with the roller 62 at the position where toner images are transferred onto sheets P as image recording mediums. Because a predetermined electric potential is also applied to the roller 63, the four-colored toner image borne on the surface of the intermediate transfer belt 5 is transferred onto a sheet when transported between the rollers 62 and 63.

As shown in FIG. 1, a cleaning unit 6 is provided to the opposite side of the intermediate image transfer belt 5 from the side of the photosensitive drums 3M, 3C, 3Y, 3Bk. The cleaning unit 6 includes a case 66 and a brush 65 made from an electrically conductive material. The brush 65 is adapted to remove residual toner from the surface of the intermediate image transfer belt 5, and the case 66 is adapted to hold the removed toner.

The fixing unit 8 includes a heat roller 82 and a pressure roller 81. A sheet bearing a four-color toner image thereon is transported between and pressed by the heat roller 82 and the pressure roller 81 so that the toner image is fixed onto the sheet.

The sheet-feed unit 9 includes a sheet tray 9 for holding sheets P and a pick-up roller 92 for feeding out sheets P from the sheet tray 9. The sheet-feed unit 9 is adapted to feed out sheets P at a predetermined timing in timed relation with image formation processes performed by the LED arrays 72M, 72C, 72Y, 72Bk, the visible image forming portion 4, the photosensitive drums 3M, 3C, 3Y, 3Bk, and the intermediate image transfer belt 5. A pair of transport rollers 16 are provided between the pick-up roller 92 and the drive roller 62 for transporting sheets P fed out by the sheet-feed unit 9 to the pressure position of the intermediate image transfer belt 5 and the roller 63.

The sheet-discharge tray 10 is provided at the sheet-discharge side of the fixing unit 8 for receiving sheets P that were discharged from the fixing unit 8. Two pairs of transport rollers 17 and 18 are provided between the fixing unit 8 and the sheet-discharge tray 10 for transporting the sheet P from the fixing unit 8 to the discharge tray 1.

A front cover 2 is provided to the main frame 1A. The front cover 2 is pivotally connected to the main frame 1A at a pivot shaft 20 and is movable in a vertical direction as indicated by an arrow in FIG. 1. FIG. 2 shows the front cover 2 in an opened up condition. This configuration facilitates exchange of the developing units 51M, 52C, 51Y, 5Bk. It should be noted that although the shaft 20 of the present embodiment extends in a horizontal direction, the shaft 20 could be oriented parallel with the vertical direction so that the front cover can be opened or closed in a horizontal locus.

Figure 3:
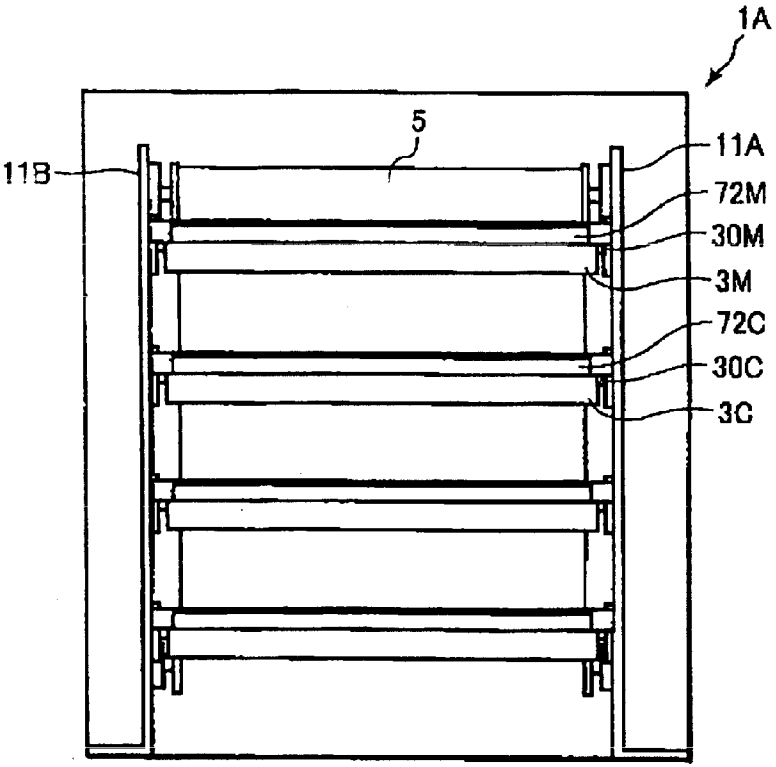
FIG. 3 is a front view showing a positional relationship among photosensitive drums, LED arrays, and a frame as a result of opening the front cover as viewed from front side of FIG. 1.

As shown in FIG. 3, the main frame 1A includes side frames 11A, 11B provided at longitudinal edges of the intermediate image transfer belt 5. The side frames 11A, 11B serve as positioning members for supporting rotational axes of the drive rollers 60, 62 of the intermediate image transfer belt 5 and for supporting rotation axes of the photosensitive drums 3M, 3C, 3Y, 3Bk. The side frames 11A, 11B also serve as support members for supporting the LED arrays 72M, 72C, 72Y, 72Bk. In order to facilitate explanation, FIG. 3, shows a front view for description of the positional relationship among the LED arrays 72M, 72C, 72Y, 72Bk, the photosensitive drums 3M, 3C, 3Y, 3Bk and the side frames 11A, 11B eliminating the developing units 51M, 52C, 51y, 51Bk.

Figure 4:
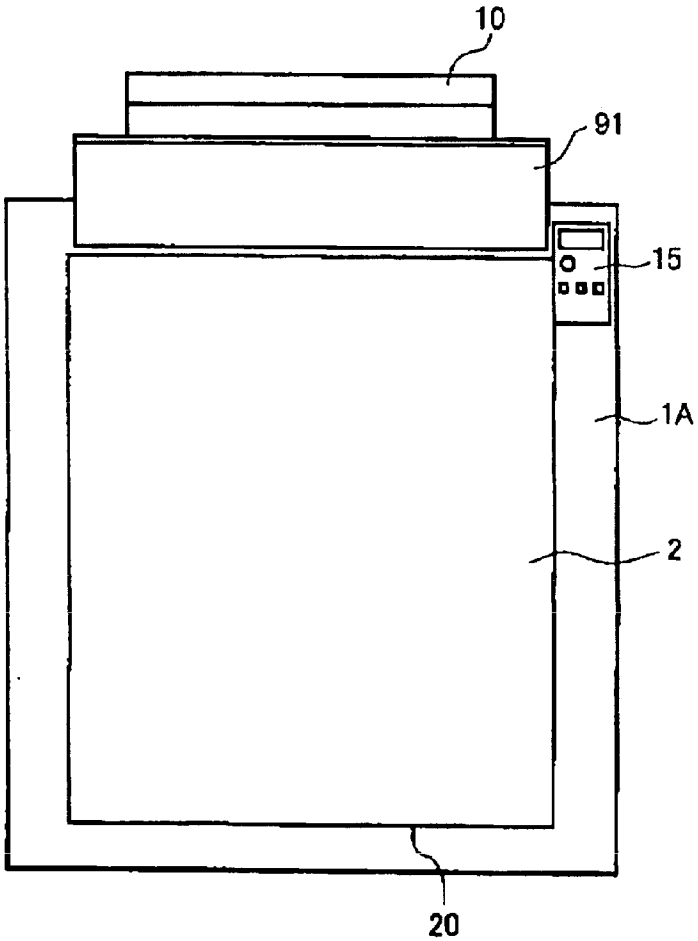
FIG. 4 is a front view showing the front cover and an operation panel in the color laser printer according to the first embodiment.

As shown in FIG. 2, the side frames 11A, 11B are formed with a positioning hole 12 for positioning the rotation shaft 30M of the photosensitive drum 3M and a guide groove 13 for guiding the rotation shaft 30M to the positioning hole 12 The frames 11A, 11B are also formed with positioning holes and guide grooves in the same manner for each of the rotation shafts 30C, 30Y, 30Bk of the photosensitive drums 3C, 3Y, 3Bk. Thus, as shown in FIG. 3 the rotation shafts 30M, 30C, 30Y, 30Bk are positioned at their given positions with respect to the side frames 11A, 11B. The LED arrays 72M, 72C, 72Y, 72Bk are attached to the side frames 11A, 11B as shown in FIG. 3 and are fixed in place with respect to the printer 1. Also, each guide groove 13 extends downward below the corresponding positioning holes 12, and the LED arrays 72 are provided above the corresponding positioning holes 12. Further, as shown in FIG. 4, an operation panel 15 is provided to the upper right side surface of the front end of the printer 1. Any operation buttons on the panel 15 is operated to be movable in the frontward/backward direction of the printer 1.

Next, operation of the color image forming device according to the first embodiment will be described. First, the chargers 71M, 71C, 71Y, 71Bk uniformly charge the photosensitive layer of the photosensitive drums 3M, 3C, 3Y, 3Bk Next, the LED arrays 72M, 72C, 72Y*m*, 72Bk emit LED light based on magenta, cyan, yellow, and black colored images to expose the photosensitive layers of the photosensitive drums 3M, 3C, 3Y, 3Bk so that electrostatic latent images are formed on the photosensitive layers of the photosensitive drums 3M, 3C, 3Y, 3Bk. The developing units 51M, 51C, 51Y, 51Bk apply magenta-, cyan-, yellow-, and black-colored toner to the electrostatic latent images to develop the images into magenta, cyan, yellow, and black colors. The magenta-, cyan-, yellow-, and black-colored toner images formed in this manner are temporarily transferred onto the surface of the intermediate image transfer belt 5. The different colored toner images are formed with a slight shift in time therebetween based on movement speed of the intermediate image transfer belt 5 and the position of the photosensitive drums 3M, 3C, 3Y, 3Bk, so that these toner images are transferred to properly overlap on the intermediate image transfer belt 5.

Then the cleaning rollers 70M, 70C, 70Y, and 70Bk remove the residual toner left on the surface of the photosensitive drums 3M, 3C, 3Y, 3Bk after transfer of the toner images. The four-colored toner image formed on the intermediate image transfer belt 5 is transferred onto the sheet supplied from the sheet-feed unit 9 at the pressure position between the rollers 62 and 63. Then the fixing unit 8 fixes the toner image onto the sheet P and the sheet P is discharged onto the sheet-discharge tray 10. Thus, a four-colored image is formed on the sheet P.

The color image forming device according to the present embodiment is a tandem type device wherein visible image forming portions 4 for various color are aligned in the movement direction of the intermediate image transfer belt 5. Therefore, color images can be formed as almost quickly as when forming monochrome images. The intermediate image transfer belt 5 enables a long surface in confrontation with the visible image forming portions 4, so that the visible image forming portions 4 can be aligned vertically as described above. As a result, the image forming device occupies less area than does a conventional image forming device with visible image forming portions aligned horizontally.

For exchanging the process cartridge with a new process cartridge, the front cover 2 is pivotally opened as shown in FIG. 2. In this case, the process cartridge is easily accessible without any interference with the side frames 11A, 11B, the axially end portions of the shafts of the rollers 60, 62, nor axially end portions of the shafts of the photosensitive drums. In other words, because the process cartridges can be easily exchanged, the process cartridge can be reliably mounted at the proper position to attach the rotation shaft 30M into the positioning hole 12 As a result, there will be no positional displacement between the neighboring process cartridges. Consequently, it becomes possible to prevent one specific color image from being displaced from the remaining color images.

Further, as described above, the LED arrays 72M, 72C, 72Y, 72Bk are fixed in place with respect to the side frames 1A, 1B, and each guide groove 13 extends downward below the corresponding positioning holes 12 and the LED arrays 72 are provided above the corresponding positioning holes 12. With this arrangement, the photosensitive drums 3M, 3C, 3Y, 3Bk are moved downwardly for detaching the photosensitive drums 3M, 3C, 3Y, 3Bk from the side frames. Accordingly, the processes cartridges can be detached without the interference from the frames 11A, 11B, which support the LED arrays 72M, 72C, 72Y, 72Bk. Accordingly, the LED arrays 72M, 72C, 72Y, 72Bk will not be shifted out of place from each other even by operation for exchanging the process cartridges. This also reliably prevents the different colored toner images from being shifted out of place from each other.

Further, because the printer 1 employs cleaner-less development method, residual toner that was once removed by the cleaning rollers 70M, 70C, 70Y, 70Bk can be returned to the photosensitive drums 3M, 3C, 3Y, 3Bk during a predetermined cycle after developing is completed. Accordingly there is no need to provide a container for holding waste toner. Conventional devices that do not use the cleaner-less development method require a waste toner container to be disposed somewhere around the photosensitive drum. The photosensitive drum and the waste-toner container interfere with each other during exchange of the process cartridge, thereby complicating operations for exchanging the process cartridge. However, no waste-toner container is required according to the present embodiment, so process cartridges can be easily exchanged without such problems occurring. This also reliably prevents the different colored toner images from being shifted out of place from each other.

Further, the charger 71M, 71C, 71Y, 71Bk are configured to be separated from the photosensitive drums 3M, 3C, 3Y, 3Bk as shown in FIG. 2 when the process cartridges are exchanged. Accordingly, process cartridge can be exchanged without an interference from the charger units 71M, 71C, 71Y, 71Bk. This also reliably prevents the different colored toner images from being shifted out of place from each other.

Further, as shown in FIG. 2, the detachment direction of the process cartridges is the same as the discharge direction of sheets P onto the discharge tray 10. Further, the detachment direction of the sheet-supply tray 9 is also in the same direction. Accordingly, the printer 1 can be produced in a compact size and have good operability. Further, as shown in FIG. 4, the operation panel 15 is provided to the upper right side surface of the front end of the printer 1. Accordingly, the direction for opening the front cover 2 to exchange process cartridges, the direction for removing discharged sheets, and the direction in which the operation panel 15 is operated are all the same direction so that the printer 1 has excellent operability. Further, even though the image forming device is somewhat taller because the plurality of photosensitive drums 3M, 3C, 3Y, 3Bk are aligned in the vertical direction, a user can easily access the operation panel because the operation panel 15 is not disposed on a top face but is disposed on the front surface.

Further, because of the sufficient fluidity of the polymerized toner, degradation of image is avoidable even by twice image transfer operation (from photosensitive drum to the intermediate image transfer member and from the intermediate image transfer member to the sheet P) through the intermediate image transfer member.

Next, a printer 101 according to a second embodiment of the present invention will be described with reference to FIGS. 5 to 7, wherein like parts and components are designated by the same reference numerals as those shown in the first embodiment but adding 100 to the same reference numerals to avoid duplicating description.

Figure 5:
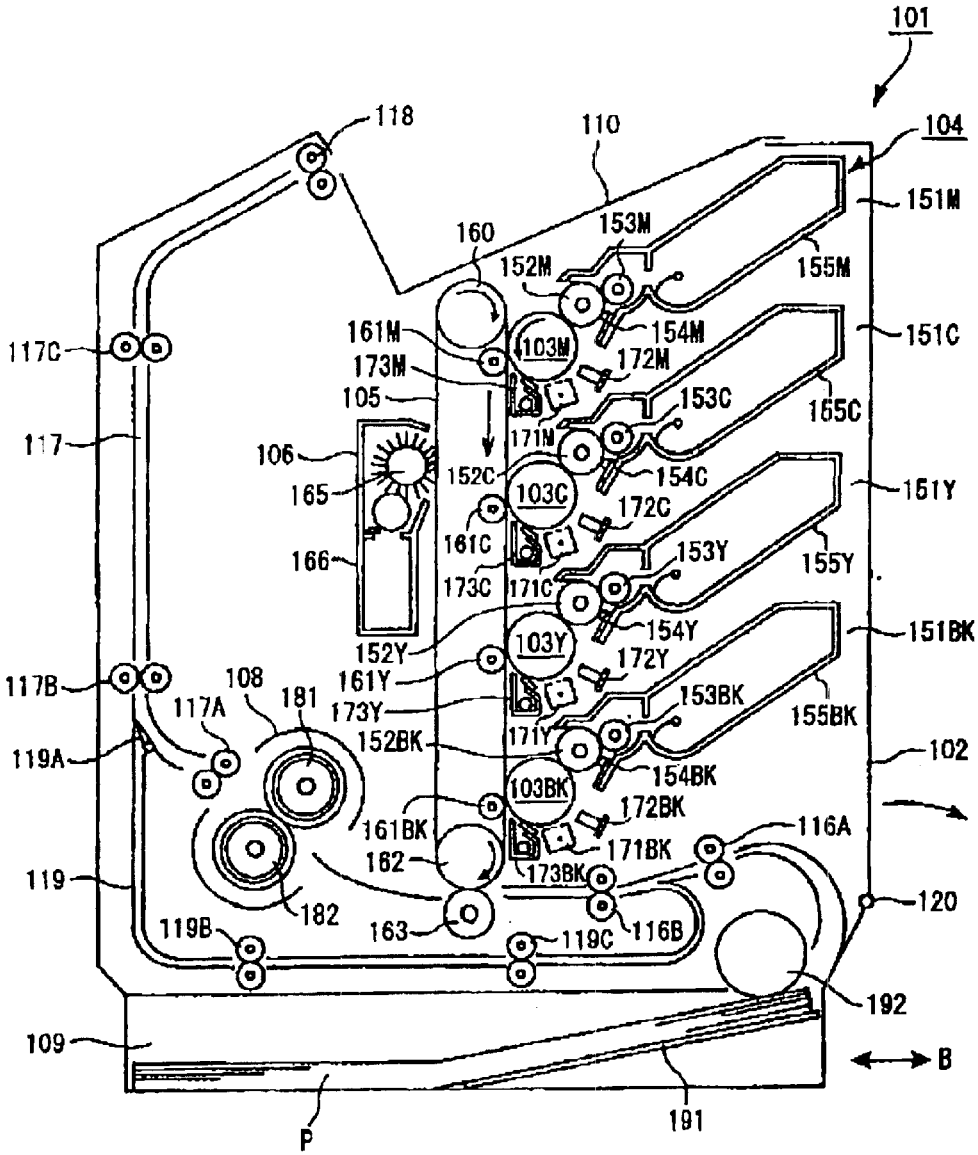
FIG. 5 is a schematic cross-sectional side view showing a color laser printer according to a second embodiment of the present invention.

In the second embodiment, as shown in FIG. 5, the surface of the intermediate image transfer belt 105 facing the photosensitive drums 103M, 103C, 103Y, 103Bk moves downward rather than upward in contrast to the printer 1 of the first embodiment. In association with this running direction of the intermediate image transfer belt 105, the sheet-supply unit 109 and the transfer roller 163 are positioned lower than the intermediate image transfer belt 105 as shown in FIG. 5. Also, the photosensitive drums 103M, 103C, 103Y, 103Bk rotate in counterclockwise direction as viewed in FIG. 5. Also, to match this, cleaning units 173M, 173C, 173Y, 173Bk (described later), the charge units 171M, 171C, 171Y, 171Bk, and the LED arrays 172M, 172C, 172Y, 172Bk are positioned lower than the photosensitive drums 103M, 103C, 103Y, 103Bk. Further, the layer-thickness regulating blades 154M, 154C, 154Y, 154Bk are positioned lower than the developing rollers 152M, 152C, 152Y, 152Bk.

The printer 101 of the second embodiment further includes configuration for enabling printing on both sides of sheets. To this effect, in addition to a sheet passage 117 from the fixing unit 108 to the discharge tray 110, another sheet passage 119 are provided as a reverse passage. First, a configuration for normal sheet transport will be described.

As shown in FIG. 5, transport roller pairs 116A, 116B are provided upstream of the roller 163 for transporting sheets fed out by the pick-up roller 192 to the toner image transfer position between the rollers 162 and 163. Further, transport roller pairs 117A, 117B, 117C, and 118 are disposed downstream of the fixing unit 108 for transporting sheets P with an image fixed thereon out of the printer 101.

Next, configuration for enabling both-side printing will be described. The both-side printing sheet transport path 119 extends between the transport rollers 117B and 116B. Transport roller pairs 119B and 119C are provided along the both-side printing sheet transport path 119. A path switch plate 119A is provided between the transport rollers 117A and 117B. The switch plate 119A is movable between a first position where the rollers 117A and 117B are communicated with each other and a second position where the rollers 117B and 119B are communicated with each other.

When images are to be printed on both sides of sheets P, first, the path switch plate 119A is switched to the first position indicated in FIG. 5. Next, the transport rollers 117B transport a sheet discharged from the fixing unit 108 to just before discharging out the trailing edge of the sheet P. Then the rotation of the transport rollers 117B are temporarily stopped. Next, the path switch plate 119A is pivoted in the clockwise direction as viewed in FIG. 5 to provide its second position, and the transport rollers 117B are rotated inverse to transport the sheet P into the both-side printing sheet transport path 119. The transport rollers 119B, 119C transport the sheet P through the both-side printing sheet transport path 119 back to the transport rollers 116B. During travel of the sheet in the reverse passage 119, an imaging surface of the sheet can be reversed. The transport rollers 116B transport the sheet P between the rollers 163 and the intermediate image transfer belt 105, so that a toner image is transferred onto the rear surface of the sheet P. Because images can be printed on both sides of each sheet, sheets P can be conserved.

Figure 6:
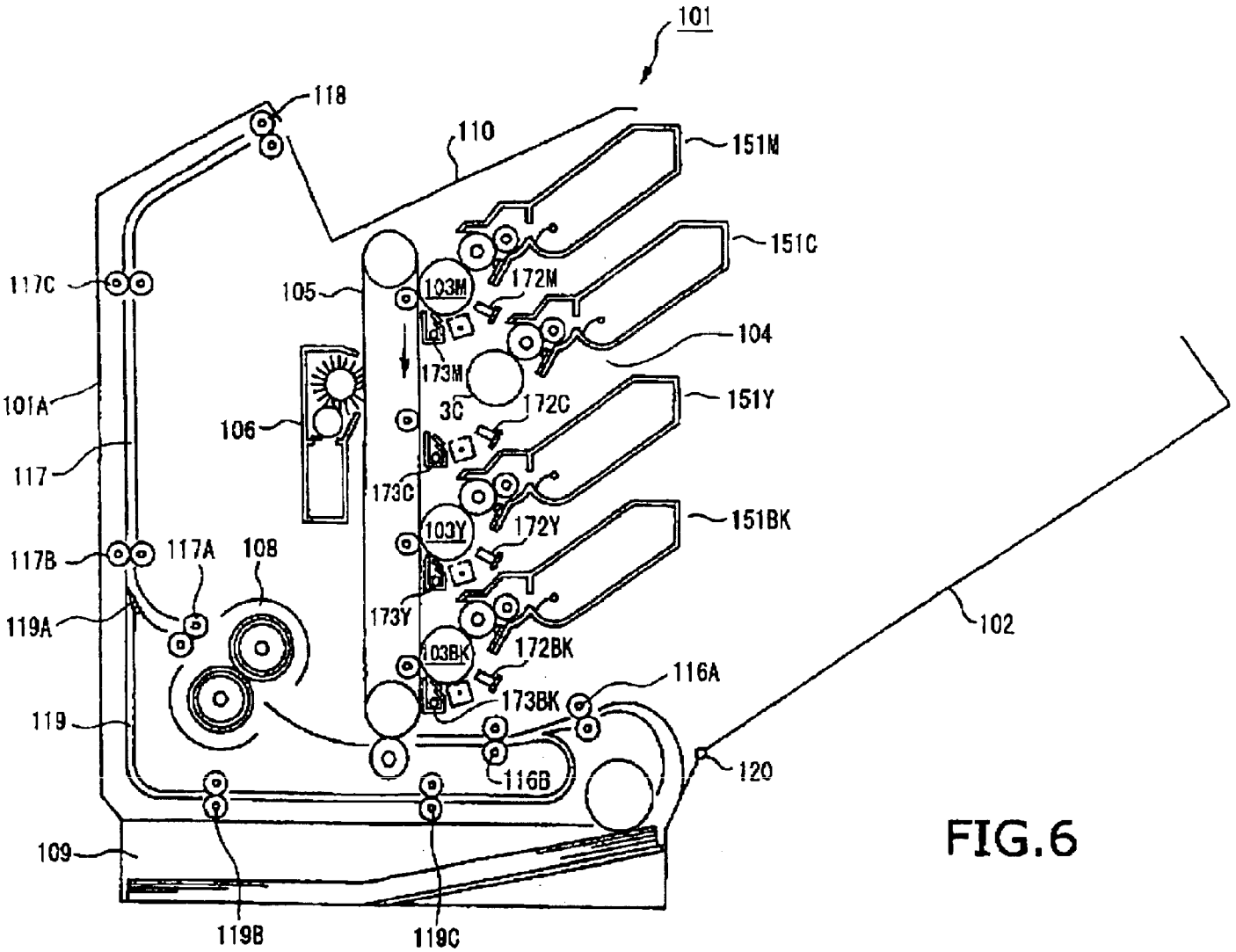
FIG. 6 is a schematic cross-sectional side view showing the state where a front cover is opened for exchanging a process cartridge according to the second embodiment.

As shown in FIG. 6, the front cover 102 is pivotally openable and closable about the pivot shaft 120 on a side of the printer 101 facing the surface of the intermediate image transfer belt 105. Therefore, the process cartridges can be easily exchanged without interference from the frames supporting various components as described above.

Further, as shown in FIG. 6, the process cartridges are removed from the printer 101 by pulling them slightly upward, whereas the LED arrays 172M, 172C, 172Y, 172Bk are disposed lower than the process cartridges, that is, in a direction opposite to the removal direction of the process cartridges. Accordingly, the LED arrays 172M, 172C, 172Y, 172Bk do not get in the way when the process cartridges are removed from the printer 101. The LED arrays 172M, 172C, 172Y, 172Bk need to be disposed near the photosensitive drums 103M, 103C, 103Y, 103Bk to properly form electrostatic latent images on the photosensitive drums 103M, 103C, 103Y, 103Bk. However, with the configuration of the second embodiment, the LED arrays 172M, 172C, 172Y, 172Bk do not interfere with operations for exchanging the process cartridges, which include the photosensitive drums 103M, 103C, 103Y, 103Bk. Accordingly, the LED arrays 172M, 172C, 172Y, 172Bk will not be moved out of alignment even by exchange of the process cartridges. This also reliably prevents the different colored toner images from being shifted out of place from each other.

Figure 7A:
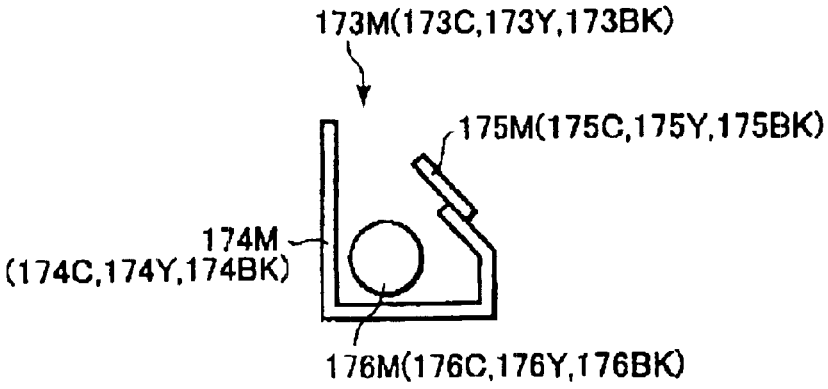
FIG. 7(*a*) is a schematic cross-sectional view showing a cleaning unit of the color laser printer according to the second embodiment.
Figure 7B:
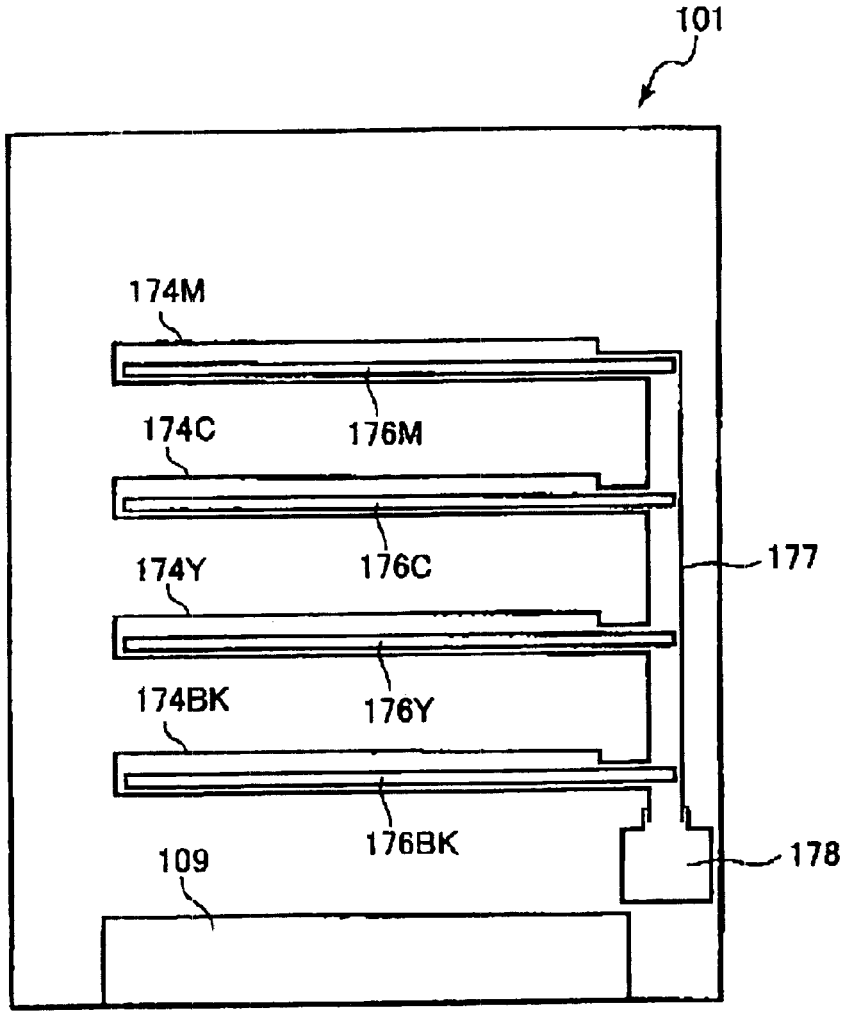

As shown in FIG. 7(*a*), the cleaning units 173M, 173C, 173Y, 173Bk are provided beside the photosensitive drums 103M, 103C, 103Y, 103Bk. These cleaning units 173M, 173C, 173Y, 173Bk are provided instead of the cleaning rollers 70M, 70C, 70Y, 70Bk of the first embodiment. In other words, the second embodiment is not the cleaner-less type. These cleaning units are configured from containers 174M, 174C, 174Y, 174Bk, blades 175M, 175C, 175Y, 175Bk, and screws 176M, 176C, 176Y, 176Bk serving as toner transferring members.

As shown in FIG. 7(*b*), the screws 176M, 176C, 176Y, 176Bk extend in the axial direction of the photosensitive drums 103M, 103C, 103Y, 103Bk. The containers 174M, 174C, 174Y, 174Bk are all connected to each other at one end by a connection pipe 177. The connection pipe 177 is connected to a waste toner container 178 positioned at a lower portion of the frame.

The cleaning units 173M, 173C, 173Y, 173Bk are fixed to the frame 101A at positions below the photosensitive drums 103M, 103Y, 103C, 103Bk, and openings of the cleaning units communicating with the corresponding photosensitive drums are directed upwardly. Therefore, during removal of the process cartridge including the photosensitive drum, the toner is not spilt out of the opening even by the movement of the photosensitive drum away from the opening.

Further, because the waste toner container 178 is disposed at the bottom of the printer 101, the waste toner container 178 will not interfere with operations for exchanging the process cartridges. The cleaning units 173M, 173C, 173Y, 173Bk are provided separately from the process cartridges and can reliably process waste toner even when a cleaner-less method is not utilized. Particularly, because the single waste toner container 178 is only provided at one position at the bottom of the printer 101, operations for exchanging the waste toner container are less troublesome than in a case where a separate waste toner containers were provided adjacent to each of the photosensitive drums. Further, because the vertical tandem system is employed, the waste toner can fall to the single waste toner container 178 by force of gravity alone after being transported to the connection pipe 177 by the screws 176M, 176C, 176Y, 176Bk. As a result, the entire configuration can be simplified.

Further, because the intermediate image transfer belt 105 runs downwardly at a side facing the photosensitive drums 103M, 103C, 103Y, 103Bk, and image transfer from the intermediate image transfer belt 105 to the sheet P is performed at the roller 163 positioned below the lowermost portion of the belt 105. Therefore, it becomes possible to position the sheet supply unit 109 at the lowermost position of the printer 101. Moreover, the sheet discharge tray 110 can be positioned above the image forming portion 104 including the process cartridges and the like. Thus, any projection away from the cross-sectional profile of the main frame can be eliminated. Moreover, sheet replenishment work can be easily performed because of the low position of the sheet supply unit 109 in comparison with a case where a sheet cassette is positioned at an upper portion of the printer. Additionally, sheet path length from the sheet supply unit 109 to the roller 163 can be reduced to reduce a printing cycle. Further, sheet passage 117 from the image transfer portion to the discharge tray 110 is positioned opposite to the process cartridges with respect to the intermediate image transfer member 105. Therefore, when the front cover 102 is open, the process cartridge can be easily accessible because of no interference with the sheet passage 117.

Further, if the layer thickness regulation blades are positioned below the developing rollers as in the second embodiment, toner circulation may be insufficient and toner stagnation on the blade may occur. However, because polymerized toners are used, such conceivable drawbacks can be eliminated because of excellent fluidity of the toners. Thus, insufficient printing can be obviated. Moreover, because of the sufficient fluidity of the polymerized toner, degradation of image is avoidable even by twice image transfer operation by way of the intermediate image transfer member. Furthermore, residual toner amount can be reduced after image transfer because of the employment of the polymerized toner.

Further, the detachment direction of the process cartridges is the same as the detachment direction of the sheet supply unit 191 as indicated by an arrow B. Therefore, working area is only required in front of the front cover 102, and ambient objects such as a desk can be positioned close to the remaining sides of the printer.

Next, a printer 201 according to a third embodiment of the present invention will be described with reference to FIG. 8, wherein like parts and components are designated by the same reference numerals as those shown in the second embodiment but adding 100 to the same reference numerals to avoid duplicating description.

The third embodiment is similar to the second embodiment except the orientation of intermediate image transfer belt 205 and employment of the cleaning rollers 270M, 270C, 270Y, 270Bk instead of the cleaning units 173M, 173C, 173Y, 173Bk.

Figure 8:
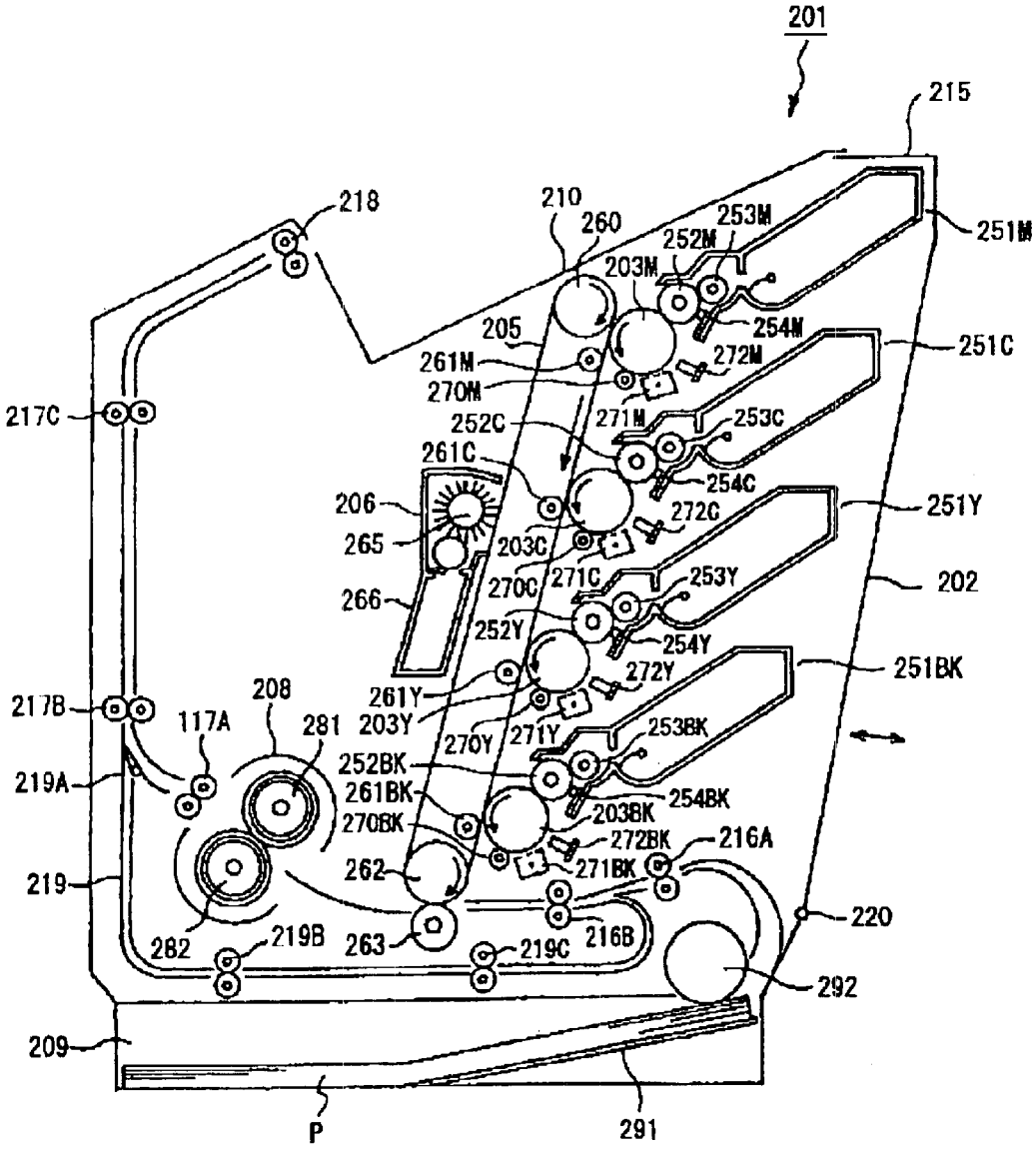
FIG. 8 is a schematic cross-sectional side view showing a color laser printer according to a third embodiment of the present invention.

More specifically, as shown in FIG. 8, the intermediate image transfer belt 205 is not vertically oriented but is slightly slanted. Even with this configuration, the installing surface area required to install the printer can be reduced.

The front cover 202 is provided on the side facing the surface of the intermediate image transfer belt 205. Therefore, operations for exchanging process cartridges can be easily performed without any interference with the frames. Accordingly, color shifts can be reliably prevented.

Further, the operation panel 215 is provided at an uppermost position of the front cover 202. Accordingly, the direction for opening and closing the front cover 202 to exchange process cartridges, the direction of removing discharged paper, and the orientation of operation panel 215 can be all the same, so that the printer 201 has excellent usability. The same effects can be achieved even if the operation panel 215 is disposed on an upper vertical surface of the frame beside the front cover, the upper surface being at the same side of the front cover 2.

Figure 9:
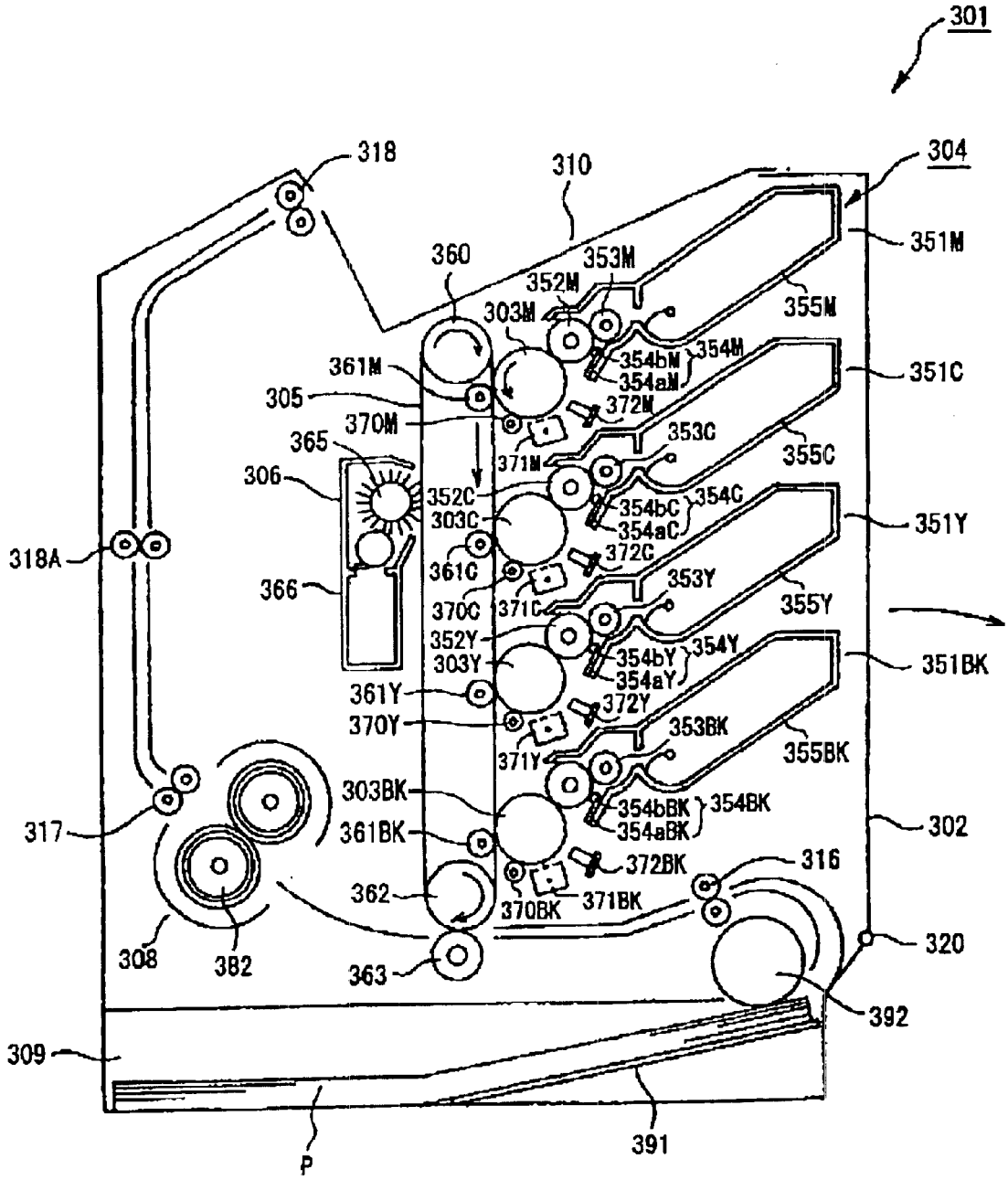
FIG. 9 is a schematic cross-sectional side view showing a color laser printer according to a fourth embodiment of the present invention.

Next, a printer 301 according to a fourth embodiment of the present invention will be described with reference to FIG. 9, wherein like parts and components are designated by the same reference numerals as those shown in the first and second embodiments but adding 300 or 200 to the same reference numerals to avoid duplicating description.

The fourth embodiment is similar to the second embodiment except that cleaning rollers 370M, 370C, 370Y, 370Bk are provided instead of the cleaning units 173M, 173C, 173Y, 173Bk, and the both-side printing sheet transport path 119 (FIG. 5) and its associated arrangement is not provided.

The layer thickness regulation blades 354M, 354C, 354Y, 354Bk are applied with predetermined voltage and are positioned such that their contact portions 354*b*M, 354*b*C, 354*b*Y, 354*b*Bk are positioned lower than a horizontal plane passing diameters of the developing rollers 352M, 352C, 352Y, 352Bk. Thus, these contact portions are urged upwardly by the corresponding support portions 354*a*M, 354*a*C, 354*a*Y, 354*a*Bk fixed to the developing cases 355M, 35C, 355Y, 355Bk and are in contact with the lower peripheral surfaces of the developing rollers 352M, 352C, 352Y, 352Bk. This description is also applicable to the second embodiment.

The cleaning rollers 370M, 370C, 370Y, 370Bk formed from resilient electrically conductive sponge are positioned below the photosensitive drums 303M, 303C, 303Y, 303Bk and are in sliding contact therewith. Further, chargers 371M, 371C, 371Y, 371Bk are also positioned below the photosensitive drums 303M, 303C, 303Y, 303Bk. LED arrays 372M, 372C, 372Y, 372Bk are also positioned below the photosensitive drums and at positions downstream of the chargers with respect to the rotating direction of the photosensitive drums.

The intermediate image transfer belt 305 runs downwardly at a side in confrontation with the photosensitive drums 303M, 303C, 303Y, 303Bk. Running speed of the intermediate image transfer member 305 is set different from a peripheral speed of the photosensitive drums 303M, 303C, 303Y, 303Bk. The sheet supply unit 309 and the sheet discharge tray 310 are positioned at the lowermost and uppermost positions of the printer 301, respectively.

Because the layer thickness regulation blades 354M, 354C, 354Y, 354Bk are positioned below the centers of the developing rollers 352M, 352C, 352Y, 352Bk, entire size of the printer 301 can be reduced. That is, if the running direction of the intermediate image transfer member 305 at the side facing the photosensitive drums 303M, 303C, 303Y, 303Bk is directed downwardly, the rotational direction of the photosensitive drums are in counterclockwise direction as shown in FIG. 9. Therefore, the cleaning rollers, the chargers and the LED arrays must be positioned below the photosensitive drum. Accordingly, sufficient space must be provided below the photosensitive drums for installing these components. Because the positions below the developing rollers 352M, 352C, 352Y, 352Bk are close to the positions below the photosensitive drums 303M, 30C, 303Y, 303Bk, installation of the layer thickness regulation blades 354M, 354C, 304Y, 304Bk at the positions below the developing rollers can save spaces above the developing rollers. Consequently, it becomes possible to position the subsequent developing roller (for example, the roller 352C) at a position immediately below the precedent charger (for example charger 371M). As a result, an entire vertical length of a process cartridge including the photosensitive drum and developing unit can be reduced. Thus, compact laser printer 301 results.

Further, because polymerized toners are used, residual toner can be removed without fail even by the employment of cleaner-less type developing method. Particularly, waste toner container is not required in case of the cleaner-less type. Thus, entire size of the printer can be reduced. In the fourth embodiment, the cleaning rollers 370M, 370C, 370Y, 370Bk are adapted to temporarily hold the toners by the action of the electrical field. The toners held by the cleaning rollers can be returned back to the photosensitive drum 303M, 303C, 303Y, 303Bk during non-imaging cycle. Therefore, even if the residual toner amount is increased, such residual toner can be surely removed at the non-imaging operation to provide a clear surface of the photosensitive drum for the subsequent imaging.

Further, because the cleaning rollers 370M, 370C, 370Y, 370Bk are positioned below the photosensitive drums 303M, 303C, 303Y, 303Bk, toners falling onto the photosensitive drum due to own gravity of the toner is avoidable. Thus, printing defect due to the falling toner can be avoided.

Figure 10:
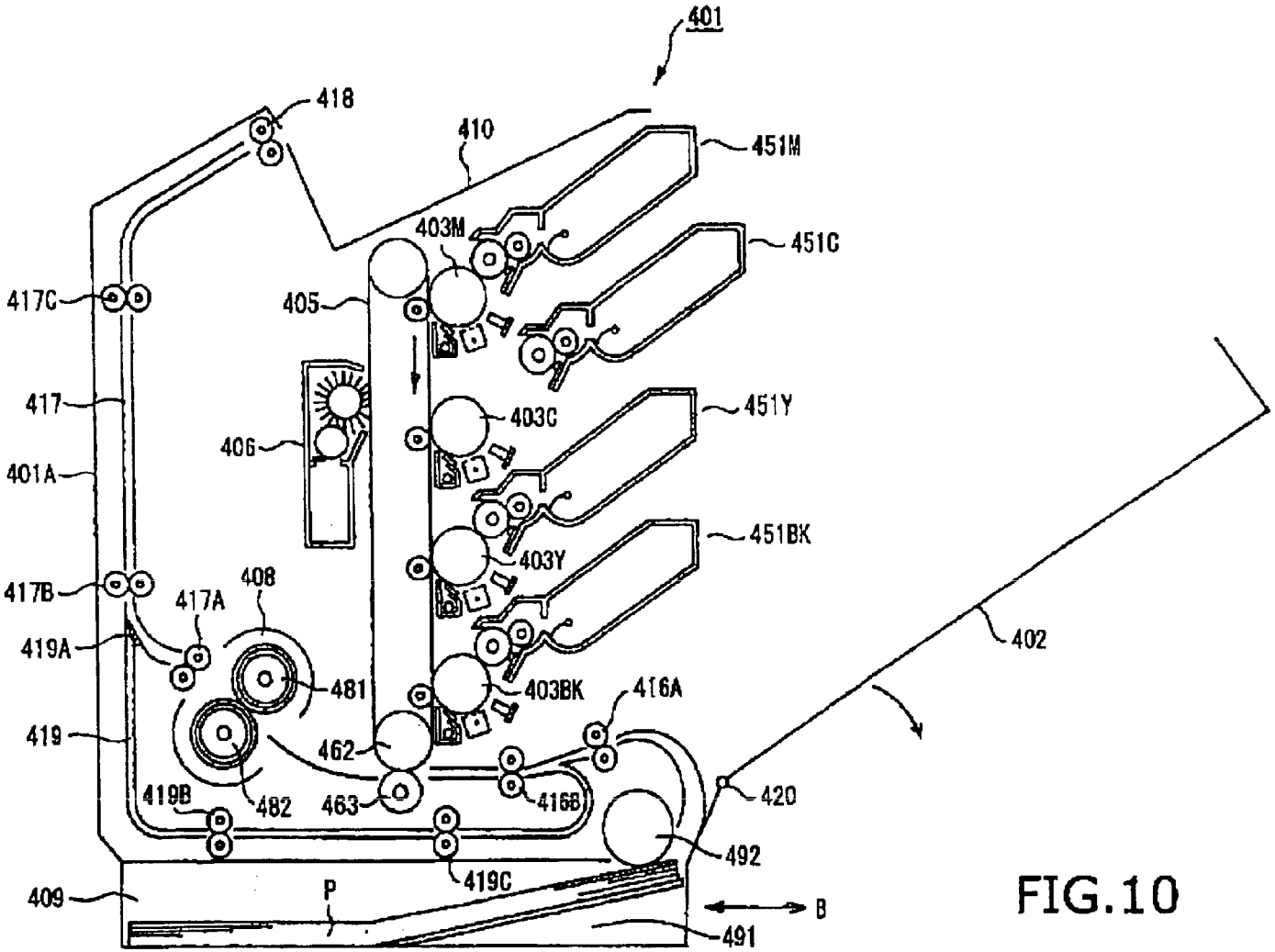
FIG. 10 is a schematic cross-sectional side view showing the state where a front cover is opened for taking out a process cartridge according to a fifth embodiment.

Next, a printer 401 according to a fifth embodiment of the present invention will be described with reference to FIG. 10, wherein like parts and components are designated by the same reference numerals as those shown in the second embodiment but adding 300 to the same reference numerals to avoid duplicating description.

The fifth embodiment is almost similar to the second embodiment. However, in the second embodiment, the developing unit 151 and the photosensitive drum 103 are incorporated into the process cartridge. On the other hand, in the fifth embodiment, the developing units 451M, 451C, 451Y, 451Bk are provided as detachable process cartridges separate from the photosensitive rums 403M, 403C, 403Y, 40Bk fixed to the frame 401A. To this effect, the photosensitive drums are made from amorphous silicon.

While the invention has been described in detail and with reference to specific embodiments thereof, it would be apparent to those skilled in the art that various changes and modifications may be made therein without departing from the spirit and scope of the invention.

For example, the present invention can be applied in the same manner to image forming devices that use nonmagnetic single-component toner made by emulsion polymerization or other methods besides the toner made by suspension polymerization. Further, the present invention can be applied to any other type of image forming device such as a copying machine and facsimile device.

What is claimed is:

1. A color image forming device, comprising:

a frame including a pair of side frames;

an elongated intermediate image transfer member running substantially in a vertical direction and positioned between the pair of side frames, the intermediate image transfer member having a first side;

a plurality of electrostatic latent image bearing bodies aligned substantially in the vertical direction and positioned in confrontation with the first side of the intermediate image transfer member, each electrostatic latent image bearing body having a latent image bearing surface;

a plurality of chargers that charge the latent image bearing surface of corresponding ones of the electrostatic latent image bearing bodies;

a plurality of exposure units that expose charged surfaces of corresponding ones of the electrostatic latent image bearing bodies; and a plurality of developing units each including a developing agent bearing body disposed in confrontation with a corresponding one of the plurality of electrostatic latent image bearing bodies and housing therein a developing agent of a predetermined color, each developing unit being assembled in a corresponding process cartridge, each process cartridge being detachably positioned at a side facing the first side of the intermediate image transfer member and moved in an attachment/detachment direction toward and away from the first side of the intermediate image transfer unit for attachment and detachment of the process cartridge with respect to the pair of side frames.

2. The color image forming device as claimed in claim 1, wherein the electrostatic latent image bearing bodies extend in an axial direction between the pair of side frames, each exposure unit comprising an LED array extending in the axial direction and fixedly secured to the frame.

3. The color image fanning device as claimed in claim 2, wherein each process cartridge at least assembles therein a developing unit and an electrostatic latent image bearing body, each LED array facing a corresponding electrostatic latent image bearing body of the electrostatic latent image bearing bodies in such a direction that the electrostatic latent image bearing body is moved away from the LED array during detachment of the process cartridge from the pair of side frames.

4. The color image forming device as claimed in claim 1, further comprising a plurality of developing agent holding units positioned beside a corresponding one of the electrostatic latent image bearing bodies, each developing agent holding unit temporarily holding residual developing agent on the electrostatic latent image bearing body and for returning the held residual developing agent to the developing agent bearing body during a predetermined cycle other than an exposing cycle.

5. The color image forming device as claimed in claim 1, wherein each process cartridge at least assembles therein a developing unit and an electrostatic latent image bearing body, each charger being fixed to the frame in such a position that each electrostatic latent image bearing body is moved away from the charger during detachment of the process cartridge from the pair of side frames.

6. The color image forming device as claimed in claim 1, further comprising:

a supply tray for supplying an image recording medium to the intermediate image transfer member, the supply tray being detachable from the frame in the attachment/detachment direction; and a discharge tray for receiving an image recording medium formed with a color image, the image recoding medium being discharged onto the discharge tray in the attachment/detachment direction perpendicular to the running direction of the intermediate image transfer member.

7. The color image forming device as claimed in claim 6, further comprising an operation panel with a variety of operation buttons, the operation panel being attached to the frame to enable access to the operation buttons from the attachment/detachment direction.

8. The color image forming device as claimed in claim 1, wherein the electrostatic latent image bearing bodies extend in an axial direction, and further comprising:

a plurality of cleaning units, each cleaning unit collecting developing agent remaining on a corresponding one of the electrostatic latent image bearing bodies, each cleaning unit being disposed externally of a corresponding process cartridge, and each cleaning unit including a transport unit for transporting collected developing agent in the axial direction of the electrostatic latent image bearing body.

9. The color image forming device as claimed in claim 1, wherein the developing agent comprises polymerized toner produced by suspension polymerization process.

10. A color image forming device comprising: a frame;

an elongated intermediate image transfer member running substantially in a vertical direction, the intermediate image transfer member having a first side;

a plurality of electrostatic latent image bearing bodies aligned substantially in the vertical direction and positioned in confrontation with the first side of the intermediate image transfer member, each electrostatic latent image bearing body having a latent image bearing surface;

a plurality of developing unit each developing unit comprising a developing agent bearing body disposed in confrontation with a corresponding one of the plurality of electrostatic latent image bearing bodies and housing therein a developing agent of a predetermined color, and a layer thickness regulation member in contact with the developing agent bearing body and positioned below the developing agent bearing body for regulating a thickness of a layer of the developing agent formed thereon, the developing agent comprising a non-magnetic single component type developing agent;

a plurality of chargers, each charger positioned in confrontation with the latent image bearing surface of a corresponding electrostatic latent image bearing body for charging the latent image bearing surface; and a plurality of exposure units, each exposure unit exposing the charged surface of a corresponding electrostatic latent image bearing body.

11. The color image forming device as claimed in claim 10, wherein the developing agent comprises polymerized toner produced by suspension polymerization process.

12. The color image forming device as claimed in claim 10, further comprising a plurality of developing agent holding units, each developing agent holding unit positioned beside a corresponding electrostatic latent image bearing body, each developing agent holding unit temporarily holding residual developing agent on the corresponding electrostatic latent image bearing body and for returning the held residual developing agent to the developing agent bearing body during a predetermined cycle other than an exposing cycle.

13. The color image forming device as claimed in claim 12, wherein each developing agent holding unit comprises a cleaning roller positioned below the electrostatic latent image bearing body, the cleaning roller holding the residual toner remaining on the electrostatic latent image bearing surface after the image transfer from the electrostatic latent image bearing body to the intermediate image transfer member.

14. The color image forming device as claimed in claim 10, further comprising:

a supply tray for supplying an image recording medium to the intermediate image transfer member, and a discharge tray for receiving an image recording medium formed with a color image, the intermediate image transfer member, the plurality of the electrostatic latent image bearing bodies, and the plurality of the developing units being positioned below the discharge tray but positioned above the supply tray.

15. The color image forming device as claimed in claim 14, wherein the frame comprises a pair of side frames, the elongated intermediate image transfer member being positioned between the pair of side frames; and wherein each developing unit is part of a process cartridge, each process cartridge being positioned at a side facing the first side of the intermediate image transfer member and movable in an attachment/detachment direction toward and away from the first side of the intermediate image transfer member for attachment and detachment of the process cartridge with respect to the pair of side frames.

16. The color image forming device as claimed in claim 15, further comprising;

a secondary image transfer device positioned immediately below the intermediate image transfer member for transferring an image from the intermediate image transfer member onto an image recording medium;

a fixing device for fixing the image onto the image recording medium after the image has been transferred from the intermediate image transfer member onto the image recording medium; and a reverse mechanism for reversing a surface of the image recording medium to provide another image onto the identical image recording medium, the reverse mechanism being connected to a downstream of the fixing device and to an upstream of the secondary image transfer device by way of a reverse print pathway extending below the intermediate image transfer member, the pathway being also positioned at a side confronting a second side of the intermediate image transfer member, the second side being opposite to the first side.

17. The color image forming device as claimed in claim 10, further comprising:

a secondary image transfer device positioned immediately below the intermediate image transfer member for transferring an image from the intermediate image transfer member onto an image recording medium;

a fixing device for fixing the image onto the image recording medium after the image has been transferred from the intermediate image transfer member onto the image recording medium; and a reverse mechanism for reversing a surface of the image recording medium to provide another image onto the identical image recording medium, the reverse mechanism being connected to a downstream of the fixing device and to an upstream of the secondary image transfer device by way of a reverse print pathway extending below the intermediate image transfer member.

18. A color image forming device, comprising:

a frame;

an elongated intermediate image transfer member running substantially in a vertical direction, the intermediate image transfer member having a first side;

a plurality of electrostatic latent image bearing bodies aligned substantially in the vertical direction and positioned in confrontation with the first side of the intermediate image transfer member, each electrostatic latent image bearing body having a latent image bearing surface;

a plurality of developing units each comprising a developing agent bearing body disposed in confrontation with a corresponding one of the plurality of electrostatic latent image bearing bodies and housing therein a developing agent of a predetermined color;

a supply tray for supplying an image recording medium to the intermediate image transfer member; and a discharge tray for receiving an image recording medium formed with a color image, the intermediate image transfer member, the plurality of the electrostatic latent image bearing bodies, and the plurality of the developing units being positioned below the discharge tray but positioned above the supply tray.

19. The color image forming device as claimed in claim 18, wherein the frame comprises a pair of side frames, the elongated intermediate image transfer member being positioned between the pair of side frames; and wherein each developing unit is part of a process cartridge, each process cartridge being detachably positioned at a side facing the first side of the intermediate transfer member and moved in an attachment/detachment direction toward and away from the first side of the intermediate image transfer member for attachment and detachment of the process cartridge with respect to the pair of side frames.

20. The color image forming device as claimed in claim 19, further comprising:

a secondary image transfer device positioned immediately below the intermediate image transfer member for transferring an image from the intermediate image transfer member onto an image recording medium;

a fixing device for fixing the image onto the image recording medium after the image has been transferred from the intermediate image transfer member onto the image recording medium; and a reverse mechanism for reversing a surface of the image recording medium to provide another image onto a reverse surface of the identical image recording medium, the reverse mechanism being connected to a downstream of the fixing device and to an upstream of the secondary image transfer device by way of a reverse print pathway extending below the intermediate image transfer member.

21. A color image forming device, comprising:

a frame;

an elongated intermediate image transfer member running substantially in a vertical direction, the intermediate image transfer member having a first side;

a plurality of electrostatic latent image bearing bodies aligned substantially in the vertical direction and positioned in confrontation with the first side of the intermediate image transfer member;

a plurality of developing units each comprising a developing agent bearing body disposed in confrontation with a corresponding one of the plurality of electrostatic latent image bearing bodies and housing therein a developing agent of a predetermined color;

a secondary image transfer device positioned immediately below the intermediate image transfer member fox transferring an image from the intermediate image transfer member onto an image recording medium;

a fixing device for fixing the image onto the image recording medium after the image has been transferred from the intermediate image transfer member onto the image recording medium; and a reverse mechanism for reversing a surface of the image recording medium to provide another image onto a reverse surface of the identical image recording medium, the reverse mechanism being connected to a downstream of the fixing device and to an upstream of the secondary image transfer device by way of a reverse print pathway extending below the intermediate image transfer member.

* * * * *